US009251744B2

(12) United States Patent
Bae et al.

(10) Patent No.: US 9,251,744 B2
(45) Date of Patent: Feb. 2, 2016

(54) DISPLAY DEVICE, RELATED CONTROL METHOD, AND RELATED CONTROLLER

(71) Applicant: Samsung Display Co., Ltd., Yongin, Gyeonggi-Do (KR)

(72) Inventors: HyeonSeok Bae, Suwon-si (KR); Namsik Ko, Yongin-si (KR); Haengwon Park, Seongnam-si (KR); Duckyong Ahn, Suwon-si (KR); Yoo jeong Lee, Cheonan-si (KR); Jooyoung Choi, Chungcheongnam-do (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/454,478

(22) Filed: Aug. 7, 2014

(65) Prior Publication Data

US 2015/0194107 A1 Jul. 9, 2015

(30) Foreign Application Priority Data

Jan. 6, 2014 (KR) ..... 10-2014-0001330

(51) Int. Cl.
*G09G 3/36* (2006.01)

(52) U.S. Cl.
CPC ..... *G09G 3/3607* (2013.01); *G09G 3/3688* (2013.01); *G09G 3/3614* (2013.01); *G09G 2310/027* (2013.01); *G09G 2320/0209* (2013.01); *G09G 2320/0233* (2013.01); *G09G 2320/0666* (2013.01)

(58) Field of Classification Search
CPC ..... G09G 2300/0452; G09G 2320/0247
See application file for complete search history.

(56) References Cited

U.S. PATENT DOCUMENTS

| | | | |
|---|---|---|---|
| 8,493,291 | B2 | 7/2013 | Nam et al. |
| 2009/0073090 | A1 | 3/2009 | Hirakawa et al. |
| 2011/0051007 | A1 | 3/2011 | Hosaka et al. |
| 2012/0032688 | A1 | 2/2012 | Christophersen et al. |
| 2012/0224685 | A1 | 9/2012 | Schenk et al. |
| 2013/0147547 | A1 | 6/2013 | Nalawade et al. |

FOREIGN PATENT DOCUMENTS

| | | |
|---|---|---|
| JP | 2009-128414 | 6/2009 |
| JP | 2009-216813 | 9/2009 |
| JP | 2010-113100 | 5/2010 |
| JP | 2012-145666 | 8/2012 |
| KR | 10-1005902 | 1/2011 |
| KR | 10-2011-0063021 | 6/2011 |
| KR | 10-2012-0116615 | 10/2012 |
| KR | 10-1212168 | 12/2012 |
| KR | 10-1277937 | 6/2013 |

*Primary Examiner* — Ricardo L Osorio
(74) *Attorney, Agent, or Firm* — Innovation Counsel LLP

(57) ABSTRACT

A display device may include a data driver, a data line, a display panel that includes a first sub-pixel and a second sub-pixel both connected to the data line and respectively positioned in a first region and a second region of the display panel, and a timing controller that may receive first-type image signals and second-type image signals. The first-type image signals may correspond to a first gray-scale and may correspond to the first region. The second-type image signals may correspond to a second gray-scale and may correspond to the second region. The timing controller may use the first gray-scale to generate a compensated gray-scale if a difference between the first gray-scale and the second gray-scale is greater than a reference value. The data driver may generate a gray-scale voltage according to the compensated gray-scale and may provide the gray-scale voltage through the data line to the first sub-pixel.

20 Claims, 10 Drawing Sheets

DISPLAY DEVICE, RELATED CONTROL METHOD, AND RELATED CONTROLLER

CROSS-REFERENCE TO RELATED APPLICATION(S)

This U.S. non-provisional patent application claims priority under 35 U.S.C. §119 to Korean Patent Application No. 10-2014-0001330, filed on Jan. 6, 2014 in the Korean Intellectual Property Office, the entire contents of which are incorporated herein by reference.

BACKGROUND OF THE INVENTION

The invention is related to a display device and a driving method (or controlling method) thereof.

In general, a display device includes a display panel for displaying images and includes drivers (e.g., a data driver and a gate driver) for controlling operation of the display panel. The display panel may include a plurality of gate lines, a plurality of data lines, and a plurality of pixels. Each of the pixels may include a thin-film transistor, a liquid crystal capacitor, and a storage capacitor. The data driver may output gray-scale voltages to the data lines, and the gate driver may output gate signals (e.g., gate-on voltages and gate-off voltages) to the gate lines.

For displaying a desired image on the display device, gate-on voltages and data voltages may be transmitted to the gate electrodes and source electrodes of the thin-film transistors via the gate lines and data lines. The data voltages should have specific levels corresponding to the desired image. If a thin-film transistor is turned on, a data voltage is applied to the corresponding liquid crystal capacitor and the corresponding storage capacitor. Ideally, the data voltage should be retained for a predetermined duration, even when the thin-film transistor is turned off. Nevertheless, parasitic capacitance between the gate electrode and the drain electrode of the thin-film transistor may lead to a variation in the applied and/or retained data voltage, which may function as a gray-scale voltage. There may be a difference between the data voltage output from the data driver and an actual data voltage applied to the liquid crystal capacitor and the storage capacitor. The voltage difference is called a kickback voltage. A large value and/or significant variation of the kickback voltage may cause quality of an image displayed by the display panel to be unsatisfactory and/or to deteriorate.

In general, each data line is connected to a plurality of pixels, and data voltages may be sequentially provided to the plurality of pixels. The data voltages sequentially applied to two pixels may be different from each other. If there is a significant difference between the data voltages applied to the two pixels, brightness non-uniformity in the displayed image may be perceived by a viewer, and the quality of the image may be unsatisfactory.

SUMMARY

Embodiments of the invention may be related to a display device capable of displaying images with satisfactory image quality and/or with minimum unwanted brightness difference. Embodiments of the invention may be related to a timing controller for controlling operation of the display device. Embodiments of the invention may be related to a method for controlling operation of the display device.

Example embodiments of the invention may be related to a display device that may include a data line. The display device may further include a display panel that includes sub-pixels. The sub-pixels may be electrically connected to the data line, may include a first sub-pixel positioned in a first region of the display panel, and may include a second sub-pixel positioned in a second region of the display panel. The display device may further include a timing controller configured to receive a set of first-type image signals and a set of second-type image signals. The first-type image signals may correspond to (and/or specify) a first gray-scale and may correspond to the first region of the display panel. The second-type image signals may correspond to (and/or specify) a second gray-scale (which may be unequal to the first gray-scale) and may correspond to the second region of the display panel (which may neighbor and/or abut the first region of the display panel). The timing controller may be configured to use the first gray-scale to generate a first compensated gray-scale if a difference between the first gray-scale and the second gray-scale is greater than a first reference value. The display device may further include a data driver electrically connected to the data line, configured to generate a first gray-scale voltage according to the first compensated gray-scale, and configured to provide the first gray-scale voltage through the data line to the first sub-pixel.

The sub-pixels may be arranged in a column that is parallel to an extending direction of the data line.

The data driver may generate a second gray-scale voltage according to the second gray-scale. The data driver may the second gray-scale voltage through the data line to the second sub-pixel after having provided the first gray-scale voltage through the data line to the first sub-pixel.

The timing controller may generate the first compensated gray-scale if the second gray-scale is greater than a second reference value.

The timing controller may generate the first compensated gray-scale if the number (i.e., quantity or amount) of the second-type image signals is greater than a threshold number.

The timing controller may generate the first compensated gray-scale if the second gray-scale is greater than a second reference value and if the first gray-scale is less than a third reference value. The third reference value may be greater than the second reference value.

The sub-pixels may further include a third sub-pixel positioned in a third region of the display panel (which may neighbor and/or abut the second region of the display panel). The timing controller may further receive a set of third-type image signals that corresponds to (and/or specifies) a third gray-scale (which may be unequal to the second gray-scale) and corresponds to the third region of the display panel. The second region may be positioned between the first region of the display panel and the third region of the display panel.

The timing controller may use the third gray-scale to generate a second compensated gray-scale if the second gray-scale is greater than a second reference value and if the third gray-scale is less than a third reference value or a fourth reference value. The data driver may generate a second gray-scale voltage according to the second compensated gray-scale and may provide the second gray-scale voltage through the data line to the third sub-pixel.

Example embodiments of the invention may be related to a timing controller connected to a data driver for controlling operation of a display panel. The display panel may include sub-pixels that are electrically connected to a data line. The data line may be electrically connected to the data driver. The sub-pixels may include a first sub-pixel positioned in a first region of the display panel and a second sub-pixel positioned in a second region of the display panel. The timing controller may include a cross-talk decision part configured to receive a set of first-type image signals and a set of second-type image signals. The first-type image signals may correspond to (and/or specify) a first gray-scale and may correspond to the first region of the display panel. The second-type image signals may correspond to (and/or specify) a second gray-scale and may correspond to the second region of the display panel. The cross-talk decision part may provide a cross-talk decision signal that has an activation value if a difference between the first gray-scale and the second gray-scale is greater than a first reference value. The timing controller may further include a compensation part configured to use the first gray-scale to generate a first compensated gray-scale in response to the cross-talk detection signal that has the activation value and configured to provide the first compensated gray-scale to the data driver for enabling the data driver to generate a first gray-scale voltage according to the first compensated gray scale and to provide the first gray-scale voltage through the data line to the first sub-pixel. The timing controller may further include hardware (e.g., electrical components and/or electronic components) configured to perform one or more tasks associated with at least one of the cross-talk decision part and the compensation part.

The sub-pixels may further include a third sub-pixel positioned in a third region of the display panel. The cross-talk decision part may further receive a set of third-type image signals that corresponds to (and/or specifies) a third gray-scale and corresponds to the third region of the display panel. The compensation part may use the third gray-scale to generate a second compensated gray-scale in response to the cross-talk detection signal that has the activation value and may provide the second compensated gray-scale to the data driver for enabling the data driver to provide a second gray-scale voltage through the data line to the third sub-pixel.

The cross-talk decision part may include the following elements: a central gray-scale decision part configured to compare a difference between the first gray-scale and the second gray-scale with the first reference value for outputting a central gray-scale decision signal; a central gray-scale size decision part configured to compare the number of the second-type image signals with a threshold number for outputting a central gray-scale size decision signal; an upper gray-scale decision part configured to compare the first gray-scale with a second reference value for outputting an upper gray-scale decision signal; a lower gray-scale decision part configured to compare the third gray-scale with a third reference value for outputting a lower gray-scale decision signal; and a logic circuit configured to generate a cross-talk detection signal in response to the central gray-scale decision signal, the central gray-scale size decision signal, the upper gray-scale decision signal, and the lower gray-scale decision signal.

The logic circuit may include the following elements: a first logic unit configured to output a first logic signal in response to the central gray-scale decision signal and the central gray-scale size decision signal; a second logic unit configured to output a second logic signal in response to the upper gray-scale decision signal and the lower gray-scale decision signal; and a third logic unit configured to output the cross-talk detection signal in response to the first logical signal and the second logic signal.

The compensation part may include the following elements: a first lookup table configured to output the first compensated gray-scale in response to at least one first-type image signal of the first-type image signals, the cross-talk detection signal, and the upper gray-scale decision signal; and a second lookup table configured to output the second compensated gray-scale in response to at least one third-type image signal of the third-type image signals, the cross-talk detection signal, and the lower gray-scale decision signal.

The first logic unit may be a first AND gate. The second logic unit may be an OR gate. The third logic unit may be a second AND gate.

The central gray-scale decision signal may have the activation value if the difference is greater than the first reference value. The central gray-scale size decision signal may have the activation value if the number of the second-type image signals is greater than the threshold number. The upper gray-scale decision signal may have the activation value if the first gray-scale is less than the second reference value. The lower gray-scale decision signal may have the activation value if the third gray-scale is less than the third reference value. The compensation part may generate the first compensated gray-scale and the second compensated gray-scale if both of the central gray-scale decision signal and the central gray-scale size decision signal have the activation value and if at least one of the upper gray-scale decision signal and the lower gray-scale decision signal has the activation value.

The compensation part may not generate the first compensated gray-scale and may not generate the second compensated gray-scale if neither of the upper gray-scale decision signal and the lower gray-scale decision signal has the activation value.

Example embodiments of the invention may be related to a method for controlling a display device. The display device may include a data driver, a data line electrically connected to the data driver, and a display panel including sub-pixels that are electrically connected to the data line. The sub-pixels may include a first sub-pixel positioned in a first region of the display panel and a second sub-pixel positioned in a second region of the display panel. The method may include receiving a set of first-type image signals and a set of second-type image signals. The first-type image signals may correspond to (and/or specify) a first gray-scale and may correspond to the first region of the display panel. The second-type image signals may correspond to (and/or specify) a second gray-scale and may correspond to the second region of the display panel. The method may further include using the first gray-scale to generate a first compensated gray-scale if a difference between the first gray-scale and the second gray-scale is greater than a first reference value. The method may further include providing the first compensated gray-scale to the data driver for enabling the data driver to generate a first gray-scale voltage according to the first compensated gray scale and to provide the first gray-scale voltage through the data line to the first sub-pixel.

The method may include the following steps: comparing the second gray-scale with a second reference value; comparing the number of the second-type image signals with a threshold number; comparing the first gray-scale with a third reference value; and generating the first compensated gray-scale if the number of the second-type image signals is greater than the threshold number and if the first gray-scale is less than the third reference value.

The method may include receiving a set of third-type image signals that corresponds to (and/or specifies) a third gray-scale and corresponds to a third region of the display panel. The sub-pixels may further include a third sub-pixel that is positioned in the third region of the display panel. The method may further include comparing the third gray-scale with a fourth reference value. The method may further include using the third gray-scale to generate a second compensated gray-scale if the difference between the first gray-scale and the second gray-scale is greater than the first reference value and if the third gray-scale is less than a second reference value. The method may further include providing the second compensated gray-scale to the data driver for enabling the data driver to generate a second gray-scale voltage according to the second compensated gray scale and to provide the second gray-scale voltage through the data line to the third sub-pixel.

The method may include the following steps: comparing the number of the second-type image signals with a threshold number; comparing the first gray-scale with a second reference value; providing the first gray-scale to the data driver for enabling the data driver to generate a first data voltage according to the first gray scale and to provide the first data voltage to the first sub-pixel if the difference is less than the first reference value, if the number of the second-type image signals is less than the threshold number, or if the first gray-scale is greater than the second reference value.

Example embodiments of the invention may be related to a display device that may include a display panel (including data lines, gate lines, and sub-pixels connected to the data and gate lines), a data driver for providing gray-scale voltages to the data lines in response to a data signal, a gate driver for providing gate signals to the gate lines, and a timing controller for controlling the data driver and the gate driver in response to image signals and control signals input from an outside source. If a series of image signals corresponds to some of the sub-pixels arranged in a specific direction and if a variation in gray-scales of the series of the image signals is larger than a reference value, the timing controller may provide a compensated data signal, obtained by compensating one or more image signals of the series of image signals, to the data driver.

The specific direction may be an extending direction of the data lines.

The series of image signals may include first-type image signals corresponding to (and/or specifying) a first gray-scale and second-type image signals corresponding to (and/or specifying) a second gray-scale, values of the first gray-scale and the second gray-scale may be different from each other, and the first-type image signals and the second-type image signals may be sequential.

The timing controller may provide the compensated data signal to the data driver if a difference between the first gray-scale and the second gray-scale is larger than a first reference value.

The timing controller may provide the compensated data signal to the data driver if the difference between the first gray-scale and the second gray-scale is larger than the first reference value and if the number of the second-type image signals is larger than a specific number.

The timing controller may provide the compensated data signal to the data driver if the second gray-scale is larger than a second reference value and if the first gray-scale is smaller than a third reference value.

The series of image signals may further include third-type image signals, which may follow the second-type image signals and may correspond to (and/or specify) a third gray-scale different from the second gray-scale.

The timing controller may provide the compensated data signal to the data driver if the second gray-scale is larger than a second reference value and if the third gray-scale is smaller than a fourth reference value.

The timing controller may include a cross-talk decision part for activating a cross-talk detection signal if the variation in gray-scale of the series of image signals provided to the sub-pixels is larger than the reference value. The timing controller may include a compensation part for compensating the one or more image signals of the series of image signals in response to the cross-talk detection signal and for outputting the compensated data signal as a compensated result.

The series of image signals may include first-type image signals corresponding to a first gray-scale, second-type image signals following the first-type image signals and corresponding to a second gray-scale different from the first gray-scale, and third-type image signals following the second-type image signals and corresponding to a third gray-scale different from the second gray-scale.

The cross-talk decision part may include the following elements: a central gray-scale decision part for comparing a difference between the first and second gray-scales with a first reference value to output a central gray-scale decision signal, a central gray-scale size decision part for outputting a central gray-scale size decision signal if the number of the second-type image signals being sequential and corresponding to the second gray-scale is larger than a specific number, an upper gray-scale decision part for comparing the first gray-scale with a second reference value to output an upper gray-scale decision signal, a lower gray-scale decision part for comparing the third gray-scale with a third reference value to output a lower gray-scale decision signal, and a logic circuit for outputting the cross-talk detection signal in response to the central gray-scale decision signal, the central gray-scale size decision signal, the upper gray-scale decision signal, and the lower gray-scale decision signal.

The logic circuit may include a first logic circuit for outputting a first logic signal in response to the central gray-scale decision signal and the central gray-scale size decision signal, a second logic circuit for outputting a second logic signal in response to the upper gray-scale decision signal and the lower gray-scale decision signal, and a third logic circuit for outputting the cross-talk detection signal in response to the first logical signal and the second logic signal.

The compensation part may include a first lookup table for outputting a first portion of the compensated data signal in response to the image signal, the cross-talk detection signal, and the upper gray-scale decision signal and may include a second lookup table for outputting a second portion of the compensated data signal in response to the image signal, the cross-talk detection signal, and the lower gray-scale decision signal.

The sub-pixels may include a first sub-pixel corresponding to a red color, a second sub-pixel corresponding to a green color, and a third sub-pixel corresponding to a blue color. The first, second, and third sub-pixels may be sequentially arranged in an extending direction of the gate lines. A pattern including a red sub-pixel, a green sub-pixel, and a blue sub-pixel may be repeated along the extending direction of the gate lines.

Each of the data lines may be disposed between a corresponding adjacent pair of the sub-pixels. Each of the sub-pixels may be electrically connected to a corresponding one of the data lines disposed to the left of the sub-pixel.

Polarities of data voltages provided to the data lines may be alternately inverted frame by frame.

Example embodiments of the invention may be related to a method for controlling a display device. The method may include receiving a series of image signals. The method may further include compensating one or more image signals of the series of image signals to generate and output a compensated data signal if the series of image signals corresponds to a plurality of sub-pixels arranged in a specific direction in the display device and if a variation in gray-scale of the series of image signals is larger than a reference value.

The series of image signals may include first-type image signals corresponding to a first gray-scale and second-type image signal following the first-type image signals and corresponding to a second gray-scale different from the first gray-scale. The step of outputting of the data signal may include comparing a difference between the first gray-scale and the second gray-scale with a first reference value, comparing the second gray-scale with a second reference value, comparing the number of the second-type image signals with a reference number, comparing the first gray-scale with a third reference value, and compensating the first-type image signals to output the data signal. The compensating may be performed if a difference between the first and second gray-scales is larger than the first reference value, if the number of the second-type image signals is larger than the reference number, and if the first gray-scale is smaller than the third reference value.

The method may further include comparing a third gray-scale with a fourth reference value and then compensating third-type image signals to output the data signal. The step of compensating may be performed if a difference between the first gray-scale and the second gray-scale is larger than the first reference value, if the number of the second-type image signals is larger than the reference number, and if the third gray-scale is smaller than a fourth reference value.

DETAILED DESCRIPTION

Figure 1:
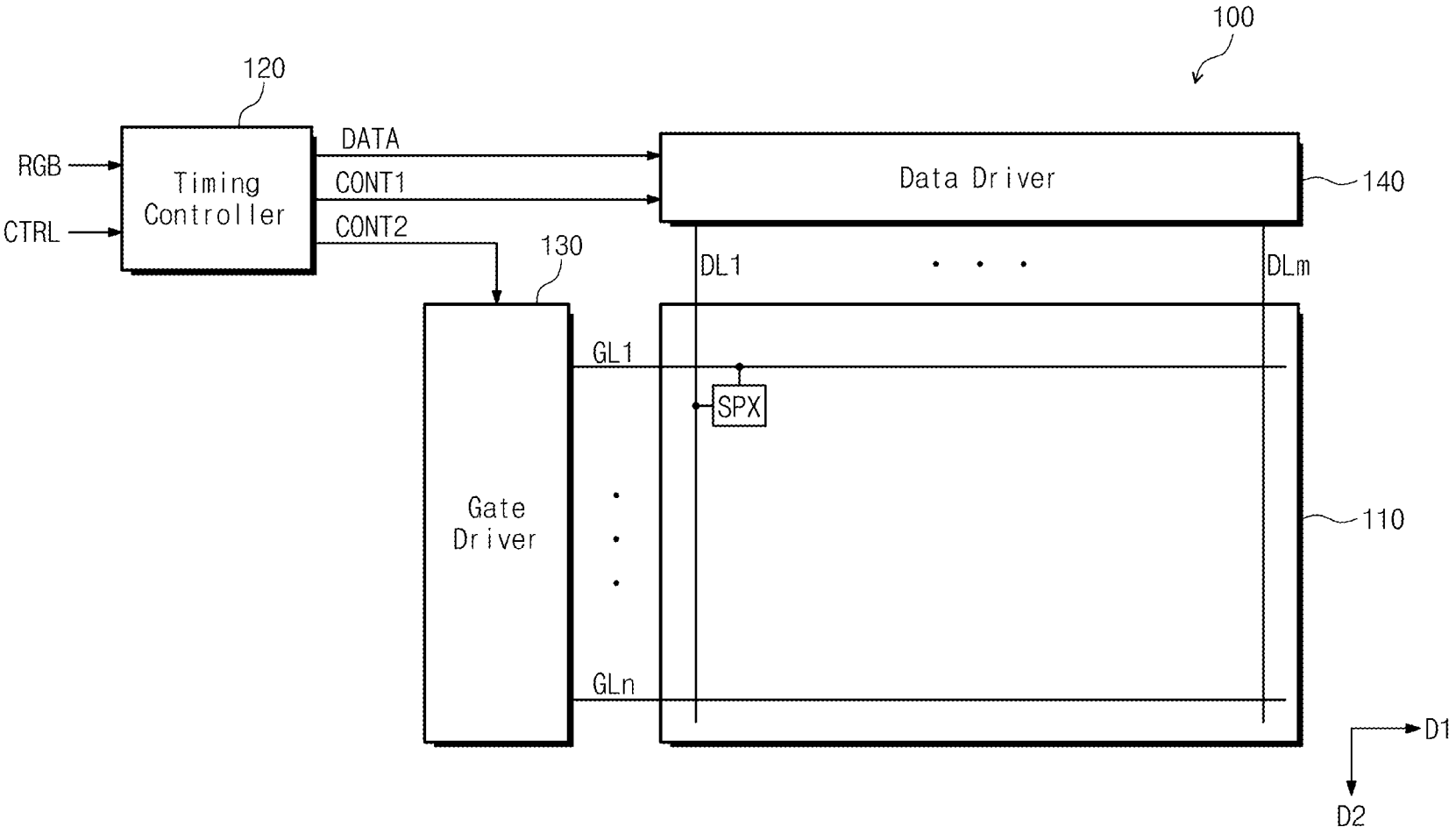
FIG. 1 is a block diagram illustrating a display device according to example embodiments of the invention.

Example embodiments of the invention will now be described more fully with reference to the accompanying drawings. Embodiments of the invention may be embodied in many different forms and should not be construed as being limited to the example embodiments set forth herein. These example embodiments are provided so that this disclosure is thorough and complete to those of ordinary skill in the art.

Various embodiments, including methods and techniques, are described in this disclosure. Embodiments of the invention may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) configured for the various operations pertaining to embodiments of the invention.

In the drawings, the thicknesses of layers and regions may be exaggerated for clarity.

Like reference numerals in the drawings may denote like elements. Description may not be repeated.

Although the terms "first", "second", etc. may be used herein to describe various elements, these elements, should not be limited by these terms. These terms may be used to distinguish one element from another element. Thus, a first element discussed below may be termed a second element without departing from the teachings of the present invention. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

If a first element is referred to as being "on", "connected" or "coupled" to second element, the first element can be directly on, directly connected, or directly coupled to the second element, or an intervening element may be present. If a first element is referred to as being "directly on", "directly connected", or "directly coupled" to a second element, there may be no intended intervening elements (except environmental elements such as air) present.

The term "and/or" may indicate any and all combinations of one or more of the associated items.

The terminology used herein is for the purpose of describing particular embodiments and is not intended to be limiting of example embodiments. The singular forms "a," "an", and "the" may include the plural forms as well, unless the context clearly indicates otherwise.

The terms "comprises", "comprising", "includes", and/or "including" may specify the presence of stated features, integers, steps, operations, elements, and/or components, but may not preclude the presence or addition of one or more other features, integers, steps, operations, elements, and/or components.

Unless otherwise defined, all terms (including technical and scientific terms) used herein have the same meaning as commonly understood by one of ordinary skill in the art. Terms, such as those defined in commonly-used dictionaries, should be interpreted as having a meaning that is consistent with their meaning in the context of the relevant art and should not be interpreted in an idealized or overly formal sense unless expressly so defined herein.

The term "connect" may mean "electrically connect". The term "insulate" may mean "electrically insulate".

FIG. 1 is a block diagram illustrating a display device 100 according to example embodiments of the invention.

Referring to FIG. 1, the display device 100 may include a display panel 110, a timing controller 120, a gate driver 130, and a data driver 140.

The display device 100 may be one of a liquid crystal display (LCD) device, a plasma panel display (PDP) device, an organic light emitting diode (OLED) device, and a field emission display (FED) device.

The display panel 110 may include a plurality of gate lines GL1-GLn extending in a first direction D1, a plurality of data lines DL1-DLm extending in a second direction D2, and a plurality of sub-pixels SPX connected to the gate and data lines. The data lines DL1-DLm may be electrically insulated from the gate lines GL1-GLn. Each of the sub-pixels SPX may include a switching transistor that is connected to a corresponding one of the data lines and a corresponding one of the gate lines and may include a liquid crystal capacitor and a storage capacitor that are connected to the switching transistor.

The timing controller 120 may receive an input image signal RGB and a control signal CTRL from an external source. The control signal CTRL may include, for example, a vertical synchronization signal, a horizontal synchronization signal, a main clock signal, a data enable signal. In the timing controller 120, the image signal RGB may be processed to generate a data signal DATA suitable for an operation condition of the display panel 110. Thereafter, the data signal DATA may be transmitted from the timing controller 120 to the data driver 140. Based on the control signal CTRL, the timing controller 120 may provide a first control signal CONT1 and a second control signal CONT2 to the data driver 140 and the gate driver 130, respectively. In example embodiments, the first control signal CONT1 may include a horizontal synchronization starting signal, a clock signal, and a line latch signal, and the second control signal CONT2 may include a vertical synchronization starting signal and an output enable signal.

In operation, data voltages (or gray-scale voltages) related to a series of image signals RGB may be consecutively applied to sub-pixels arranged in the second direction D2. If a variation in gray-scale of the image signals RGB is larger than a reference value, the timing controller 120 may provide the data signals DATA obtained by compensating the series of image signals RGB to the data driver 140.

The gate driver 130 may provide gate signals to the plurality of gate lines GL1-GLn, in response to the second control signal CONT2 from the timing controller 120. The gate driver 130 may include gate driver ICs and/or circuits that may include one or more of an ASG (Amorphous silicon gate), an amorphous Silicon Thin Film Transistor (a-Si TFT), an oxide semiconductor, a crystalline semiconductor, a polycrystalline semiconductor, etc. In embodiments, the gate driver 130 may include a gate driving integrated circuit (IC) and may be connected to a portion of an edge region of the display panel 110.

The data driver 140 may provide data voltages (or gray-scale voltages) to the plurality of data lines DL1-DLm, in response to the data signal DATA and the first control signal CONT1 from the timing controller 120.

Figure 2:
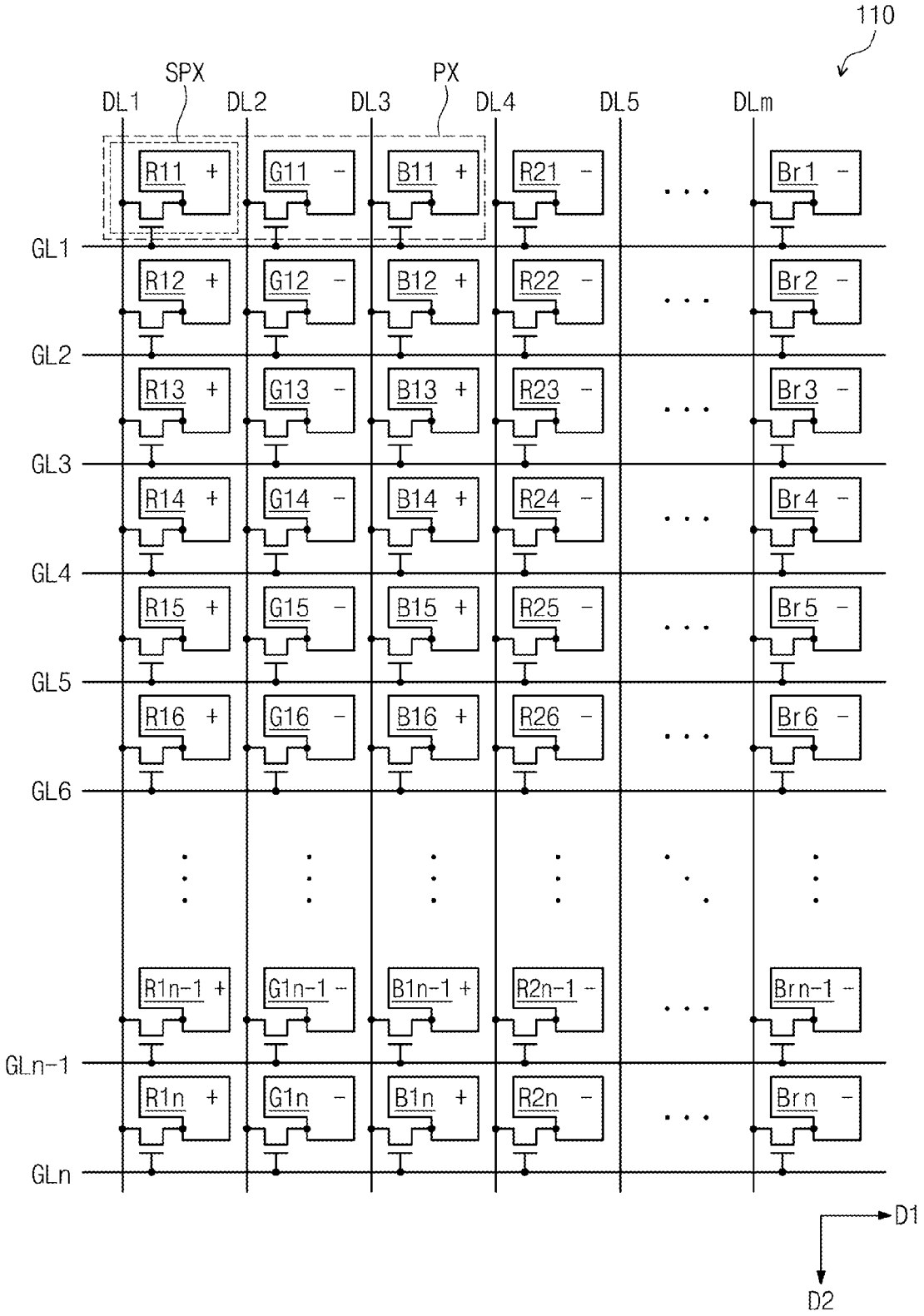
FIG. 2 is a circuit diagram illustrating an arrangement of sub-pixels provided in the display panel illustrated in FIG. 1 according to example embodiments of the invention.

FIG. 2 is a circuit diagram illustrating an arrangement of sub-pixels provided in the display panel 110 according to example embodiments of the invention.

Referring to FIG. 2, each sub-pixel SPX of the display panel 110 may represent a color sub-pixel, such as a red sub-pixel, a green sub-pixel, or a blue sub-pixel. In embodiments, the sub-pixels SPX may include red sub-pixels Rxy, green sub-pixels Rxy, and blue sub-pixels Bxy, wherein x is an integer in a range of 1 to r, y is an integer in a range of 1 to n, r is an integer, and n is an integer. Each of the pixels PX of the display panel 110 may include a red sub-pixel Rxy, a green sub-pixel Gxy, and a blue sub-pixel Bxy arranged in a row along the first direction D1.

A row of sub-pixels SPX may extend substantially parallel to the gate lines (which extend in the first direction D1), wherein sub-pixels SPX of different colors may be alternately arranged in a row. A column of sub-pixels SPX may extend substantially parallel to the data lines (which extend in the second direction D2), wherein the sub-pixels SPX arranged in a column may display the same color. For example, red sub-pixels R11-R1*n* may be arranged between data lines DL1 and D2, green sub-pixels G11-G1*n* may be arranged between data lines DL2 and DL3, and blue sub-pixels B11-B1*n* may be arranged between data lines DL3 and DL4. In embodiments, sub-pixels SPX in a row may be repeat the pattern (R, G, B) in the first direction D1. In embodiments, sub-pixels disposed in a row may repeat one or more of the following patterns: (R, B, G), (G, B, R), (G, R, B), (B, R, G), and (B, G, R).

Referring back to FIG. 2, each of the sub-pixels SPX (or Rxy, Gxy, and Bxy) may be connected to a corresponding one of the data lines, for example, provided at a left side thereof.

The sub-pixels SPX may be driven (i.e., controlled) in a column-inversion manner. In the column-inversion manner, polarities of gray-scale voltages applied to adjacent ones of the data lines may be opposite to each other with respect to a common voltage VCOM. Therefore, gray-scale voltages applied to the sub-pixels disposed immediately adjacent to each other in the first direction D1 may have opposite polarities.

Figure 3:
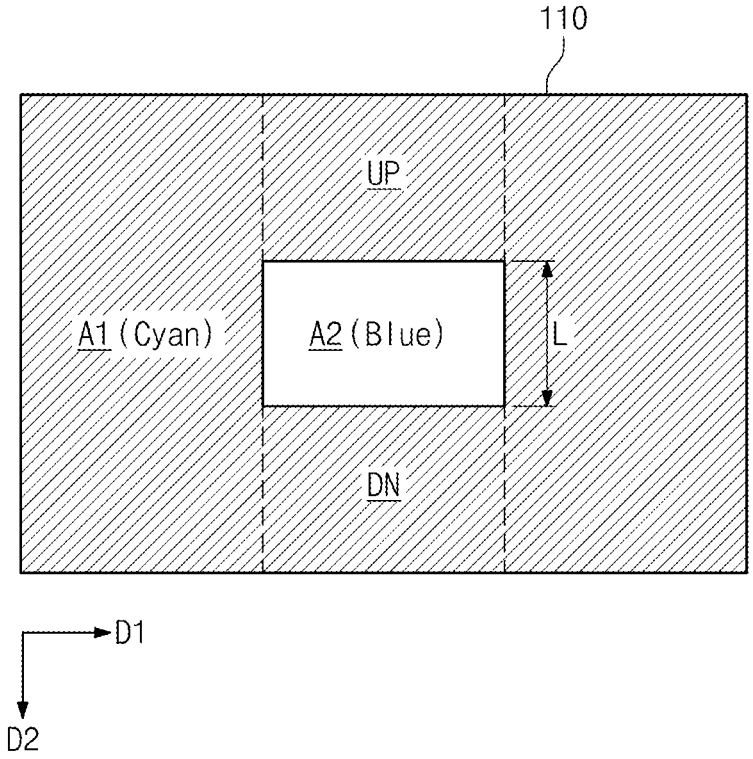
FIG. 3 is a diagram illustrating an image displayed by the display panel illustrated in FIG. 1 according to example embodiments of the invention.

FIG. 3 is a diagram illustrating an image displayed by the display panel 110 according to example embodiments of the invention.

Referring to FIG. 3, according to the image, a first region A1 of the display panel 110 may display cyan color, and a second region A2 of the display panel 110 may display blue color. The first region A1 may be adjacent to and/or may surround the second region A2. Referring back to FIG. 2, if a maximized gray-scale voltage is applied to the blue sub-pixels Bxy in the second region A2 and if a minimized gray-scale voltage is applied to the red sub-pixels Rxy and green sub-pixels Gxy in the second region A2, the blue color may be displayed in the second region A2 of the display panel 110. If the same gray-scale voltage is applied to the blue sub-pixels Bxy and green sub-pixels Gxy on the first region A1 and if a minimized gray-scale voltage is applied to the red sub-pixels Rxy in the first region A1, the cyan color may be displayed in the first region A1 of the display panel 110. The gray-scale voltage applied to the blue sub-pixels Bxy in the second region A2 (which displays the blue color) may be higher than the gray-scale voltage applied to the blue sub-pixels Bxy in the first region A1 (which displays the cyan color).

The first region A1 may include an upper region UP and a lower region DN that are spaced apart from each other by the second region A2 by a height L of the second region A2 in the second direction D2.

Figure 4:
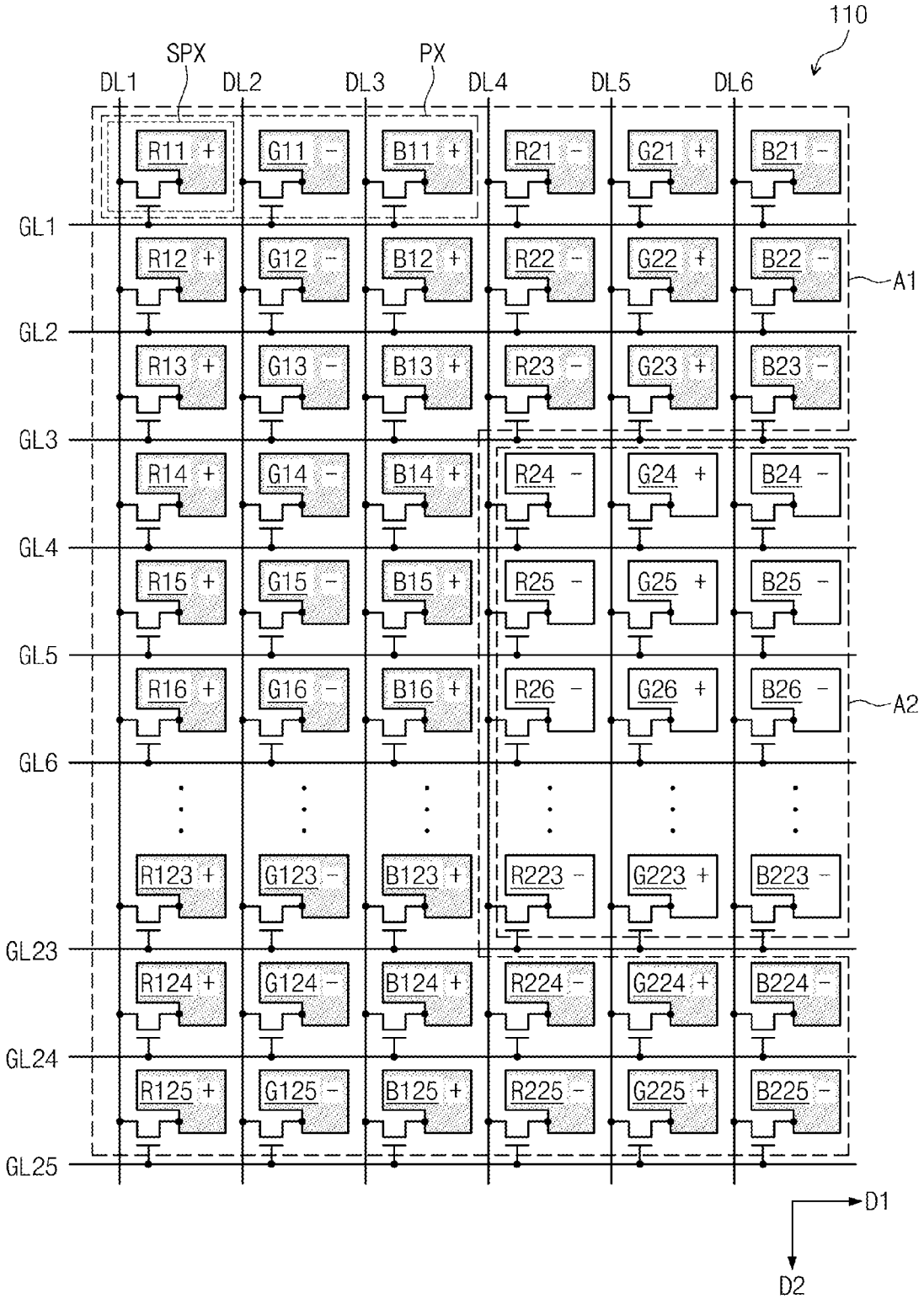
FIG. 4 is a circuit diagram illustrating states of sub-pixels when the image illustrated in FIG. 3 is displayed according to example embodiments of the invention.

FIG. 4 is a circuit diagram illustrating states of sub-pixels SPX in a portion of the display panel 110 when the image illustrated in FIG. 3 is displayed by the display panel 110.

Referring to FIGS. 3 and 4, all of the sub-pixels R11-R125, G11-G125, and B11-B125, which are connected to the data lines DL1-DL3, may be in the first region A1 and may be configured to display the cyan color. The sub-pixels SPX connected to the data lines DL4-DL6 may be classified into a first group of sub-pixels and a second group of sub-pixels. The first group of sub-pixels (e.g., R21, R22, R23, G21, G22, G23, B21, B22, B23, B224, R225, G224, G225, B224, and B225) may be positioned in the first region A1 and may be configured to display the cyan color. The second group of sub-pixels (e.g., R24-R223, G24-G223, and B24-B223) may be positioned in the second region A2 and may be configured to display the blue color.

Figure 5:
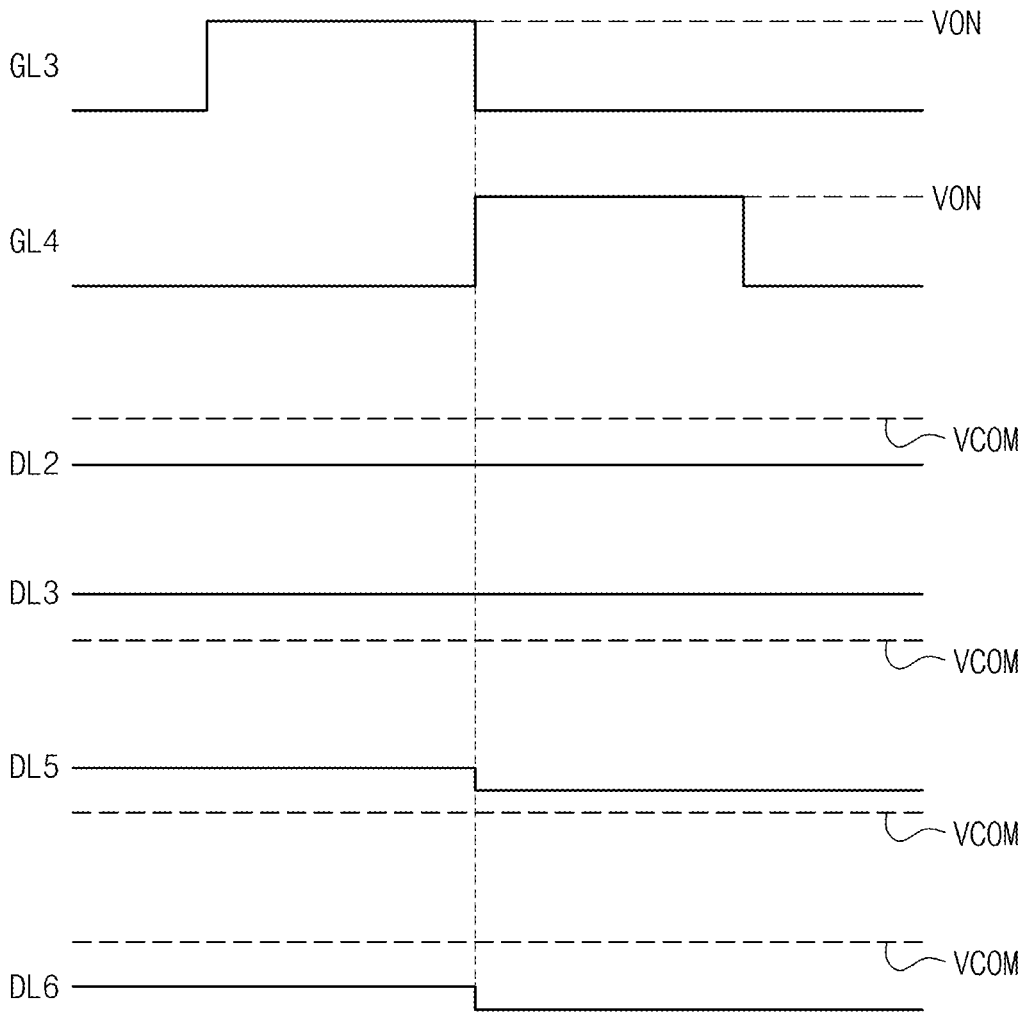
FIG. 5 is a timing diagram illustrating a driving method for controlling the display panel to be in the state illustrated in FIG. 4 according to example embodiments of the invention.

FIG. 5 is a timing diagram illustrating a driving method for controlling the display panel 110 to be in the state illustrated in FIG. 4.

Referring to FIGS. 4 and 5, if a gate-on voltage VON is applied to the gate line GL3, the switching transistors of the sub-pixels R13, G13, and B13 connected to the gate line GL3 may be turned on. Similarly, if the gate-on voltage VON is applied to the gate line GL4, the switching transistors of the sub-pixels R14, G14, and B14 connected to the gate line GL4 may be turned on. In the case where the gate-on voltage VON is sequentially applied to the gate lines GL3 and GL4, a gray-scale voltage having a voltage level (or magnitude with respect to the common voltage VCOM) corresponding to the cyan color (hereinafter referred as to a "cyan voltage level") may be applied to the green sub-pixels G13 and G14 through the data line DL2 and may be applied to the blue sub-pixels B13 and B14 through the data line DL3. After the gate lines GL3 and GL4 sequentially transmit the gate-on voltage VON, the gray-scale voltage provided to the sub-pixels G13, G14, B13, and B14 through the data lines DL2 and DL3 may be retained by the sub-pixels at the cyan voltage level.

When the gate line GL3 transmits the gate-on voltage VON, the gray-scale voltage of the cyan voltage level may be provided to the green sub-pixel G23 and the blue sub-pixel B23 through the data lines DL5 and DL6, respectively. When the gate line GL4 transmits the gate-on voltage VON, a gray-scale voltage having a level (or magnitude with respect to the common voltage VCOM) corresponding to the blue color (hereinafter referred as to a "blue voltage level") may be provided to the green sub-pixel G24 and the blue sub-pixel B24 through the data lines DL5 and DL6, respectively.

When the gate lines GL3 and GL4 sequentially transmit the gate-on voltage VON, the gray-scale voltage applied to the green sub-pixels G23 and G24 through the data line DL5 may decrease (in magnitude relative to the common voltage VCOM) from the cyan voltage level to the blue voltage level, and the gray-scale voltage applied to the blue sub-pixels B23 and B24 through the data line DL6 may increase (in magnitude relative to the common voltage VCOM) from the cyan level to the blue level.

As the result of the decrease of the gray-scale voltage provided to the data line DL5, the data line DL5 may be capacitively coupled with the green sub-pixels G21, G22, and G23, and this may lead to a reduction in brightness of the green sub-pixels G21, G22, and G23. As the result of the increase of the gray-scale voltage provided to the data line DL6, the data line DL6 may be capacitively coupled with the blue sub-pixels B21, B22, and B23, and this may lead to an increase in brightness of the blue sub-pixels B21, B22, and B23. As a result, the upper region UP of the first region A1 may display a bluish cyan color, which is slightly different from the intended cyan color.

Figure 6:
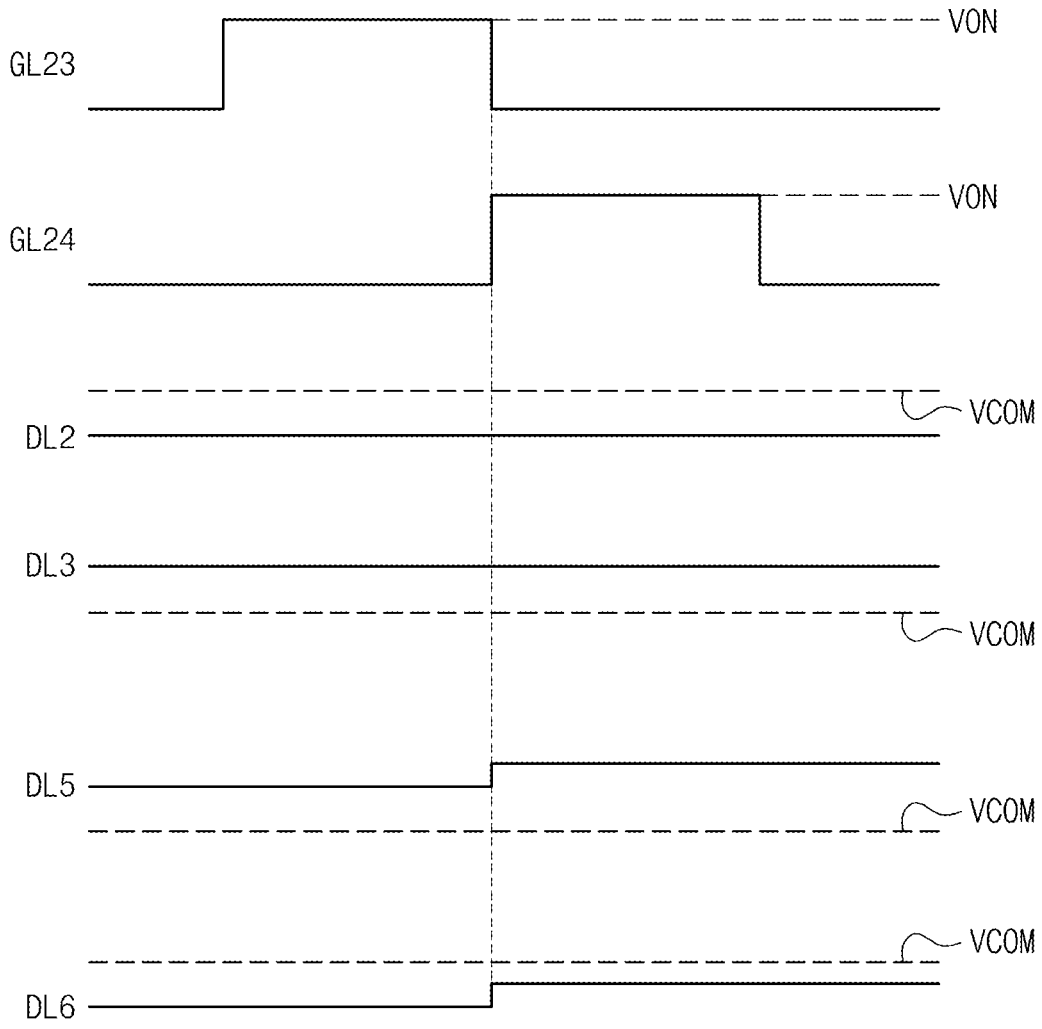
FIG. 6 is a timing diagram illustrating a driving method for controlling the display panel to be in the state illustrated in FIG. 4 according to example embodiments of the invention.

FIG. 6 is a timing diagram illustrating a driving method for controlling the display panel 110 to be in the state illustrated in FIG. 4 according to example embodiments of the invention.

Referring to FIGS. 4 and 6, if the gate-on voltage VON is applied to the gate line GL23, the switching transistors of the sub-pixels R123, G123, and B123 connected to the gate line GL23 may be turned on. Similarly, if the gate-on voltage VON is applied to the gate line GL24, the switching transistors of the sub-pixels R124, G124, and B124 connected to the gate line GL24 may be turned on. In the case where the gate-on voltage VON is sequentially applied to the gate lines GL23 and GL24, the gray-scale voltage with the cyan voltage level may be applied to the green sub-pixels G123 and G124 through the data line DL2 and may be applied to the blue sub-pixels B123 and B124 through the data line DL3. After the gate lines GL23 and GL24 sequentially transmit the gate-on voltage VON, the gray-scale voltage provided to the sub-pixels G123, G124, B123, and B124 through the data lines DL2 and DL3 may be retained by the sub-pixels at the cyan voltage level.

When the gate line GL23 transmits the gate-on voltage VON, the gray-scale voltage with the blue voltage level may be provided to the green sub-pixel G223 and the blue sub-pixel B223 through the data lines DL5 and DL6, respectively. When the gate line GL24 transmits the gate-on voltage VON, the gray-scale voltage of the cyan voltage level may be provided to the green sub-pixels G224 and the blue sub-pixels B224 through the data lines DL5 and DL6, respectively.

When the gate lines GL23 and GL24 sequentially transmit the gate-on voltage VON, the gray-scale voltage applied to the data line DL5 may increase (in magnitude relative to the common voltage VCOM) from the blue level to the cyan level, and the gray-scale voltage applied to the data line DL6 may decrease (in magnitude relative to the common voltage VCOM) from the blue level to the cyan level.

As the result of the increase of the gray-scale voltage provided to the data line DL5, the data line DL5 may be capacitively coupled with the green sub-pixels G224 and G225, and this may lead to an increase in brightness of the green sub-pixels G224 and G225. As the result of the decrease of the gray-scale voltage provided to the data line DL6, the data line DL6 may be capacitively coupled with the blue sub-pixels B224 and B225, and this may lead to a reduction in brightness of the blue sub-pixels B224 and B225. As a result, the lower region DN of the first region A1 may display a greenish cyan color, which is slightly different from the intended cyan color.

Figure 7:
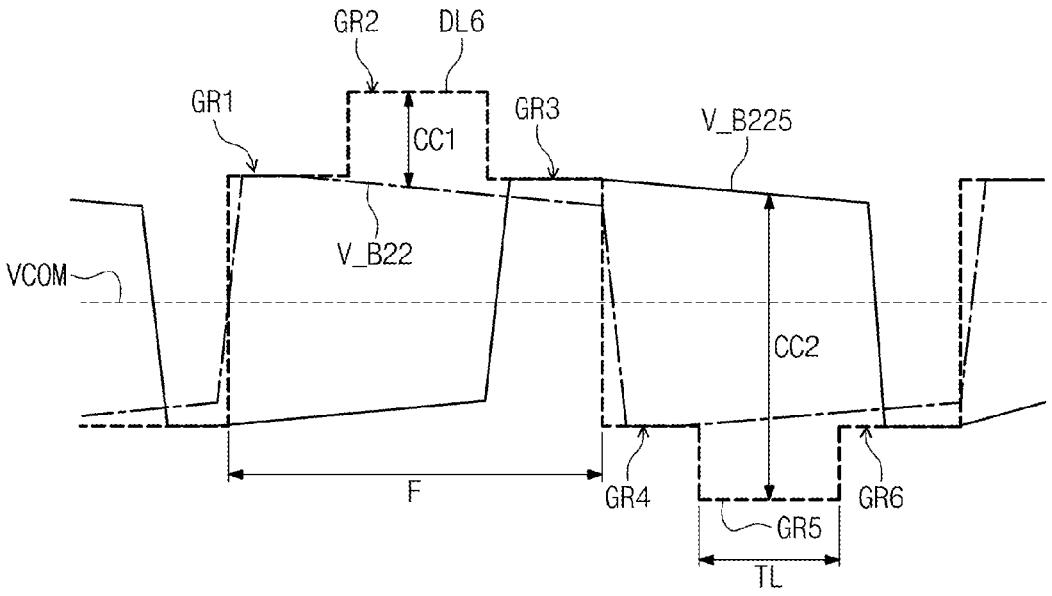
FIG. 7 is a timing diagram illustrating dependence of a pixel voltage on a variation in a data voltage (or gray-scale voltage) transmitted through a data line according to example embodiments of the invention.

FIG. 7 is a timing diagram illustrating dependence of a pixel voltage on a variation in gray-scale voltage transmitted through the data line DL6 illustrated in FIG. 4 according to example embodiments of the invention.

Referring to FIGS. 3, 4, and 7, the gray-scale voltages provided to the blue sub-pixels B21-B225 through the data line DL6 may have relative-to-VCOM magnitudes GRn (n being an integer), which represent absolute (or positive) values relative to VCOM, higher in the second region A2 than in the regions UP and DN. For example, in a first frame, GR1<GR2, and GR3<GR2; in a second frame, GR4<GR5, and GR6<GR5. Each of GR2 and GR5 may be applied for a time duration TL that corresponds to the height L of the second region A2. This is because relative-to-VCOM magnitudes of gray-scale voltages applied to the blue sub-pixels B24-B223 to display the blue color are higher than relative-to-VCOM magnitudes of gray-scale voltages applied to the blue sub-pixels B21-B23 and B224-B225 to display the cyan color.

The gray-scale voltage V_B22 provided to the blue sub-pixel B22 through the data line DL6 should be preserved (or retained) during at least one frame F. In embodiments, the gray-scale voltage transferred through the data line DL6 increases from a GR1 level to a GR2 level, such that a coupling capacitance CC1 between the data line DL6 and the blue sub-pixel B22 increases according to a difference between GR2 and V_B22.

The gray-scale voltage V_B225 provided the blue sub-pixel B225 through the data line DL6 should be preserved (or retained) during at least one frame F. In embodiments, since the blue sub-pixel B225 is located at a region lower than the blue sub-pixel B22 in the second direction D2 in the display panel 110, the switching transistor of the blue sub-pixel B225 is turned on later than that of the blue sub-pixel B22. Accordingly, the blue sub-pixel B225 may be coupled with a gray-scale voltage GR5, which is provided during a next frame and has an inverted phase. Since a difference between V_B225 and GR5 may be greater than the difference between GR2 and V_B22, a coupling capacitance CC2 between the blue sub-pixel B225 and the data line DL6 may become greater (i.e., may have a larger magnitude) than the coupling capacitance CC1 between the blue sub-pixel B22 and the data line DL6. Thus, a variation in brightness of the display panel 110 caused by the coupling capacitance CC2 may be larger on the lower region DN than on the upper region UP. According to example embodiments of the invention, the display device 100 may be configured to substantially prevent or minimize cross-talk issues caused by coupling capacitances.

Figure 8:
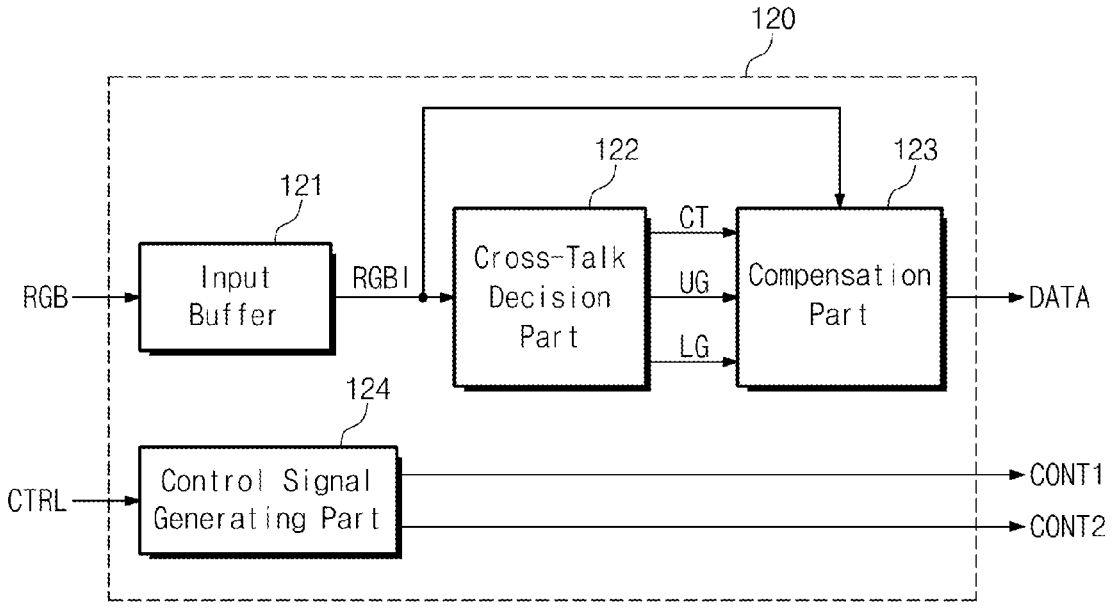
FIG. 8 is a block diagram illustrating a timing controller of a display device according to example embodiments of the invention.

FIG. 8 is a block diagram illustrating the timing controller 120 of the display device 100 illustrated in FIG. 1 according to example embodiments of the invention.

Referring to FIG. 8, the timing controller 120 may include an input buffer 121, a cross-talk decision part 122, a compensation part 123, and a control signal generating part 124. The input buffer 121 may be configured to store input image signals RGB frame by frame and may provide image signals RGBI. The cross-talk decision part 122 may receive an image signal RGBI from the input buffer 121 and may then determine whether the image signal RGBI falls into a category of cross-talk image patterns associated with one or more cross-talk issues. Based on the result of the determination, the cross-talk decision part 122 may provide a cross-talk decision signal CT, an upper gray-scale decision signal UG, and a lower gray-scale decision signal LG to the compensation part 123. In example embodiments, if a variation in gray-scales of a series of image signals RGBI is larger than a reference value, the compensation part 123 may use the cross-talk decision signal CT, the upper gray-scale decision signal UG, and the lower gray-scale decision signal LG, in addition to the image signal RGBI, to produce a data signal DATA.

In the compensation part 123, the image signal RGBI transmitted from the input buffer 121 may be compensated to produce the data signal DATA. The compensation of the image signal RGBI may be performed using the cross-talk decision signal CT, the upper gray-scale decision signal UG, and the lower gray-scale decision signal LG from the cross-talk decision part 122.

The control signal generating part 124 may receive the control signal CTRL and may accordingly generate the first control signal CONT1 and the second control signal CONT2, which will be transferred to the data driver 140 and the gate driver 130, respectively.

Figure 9:
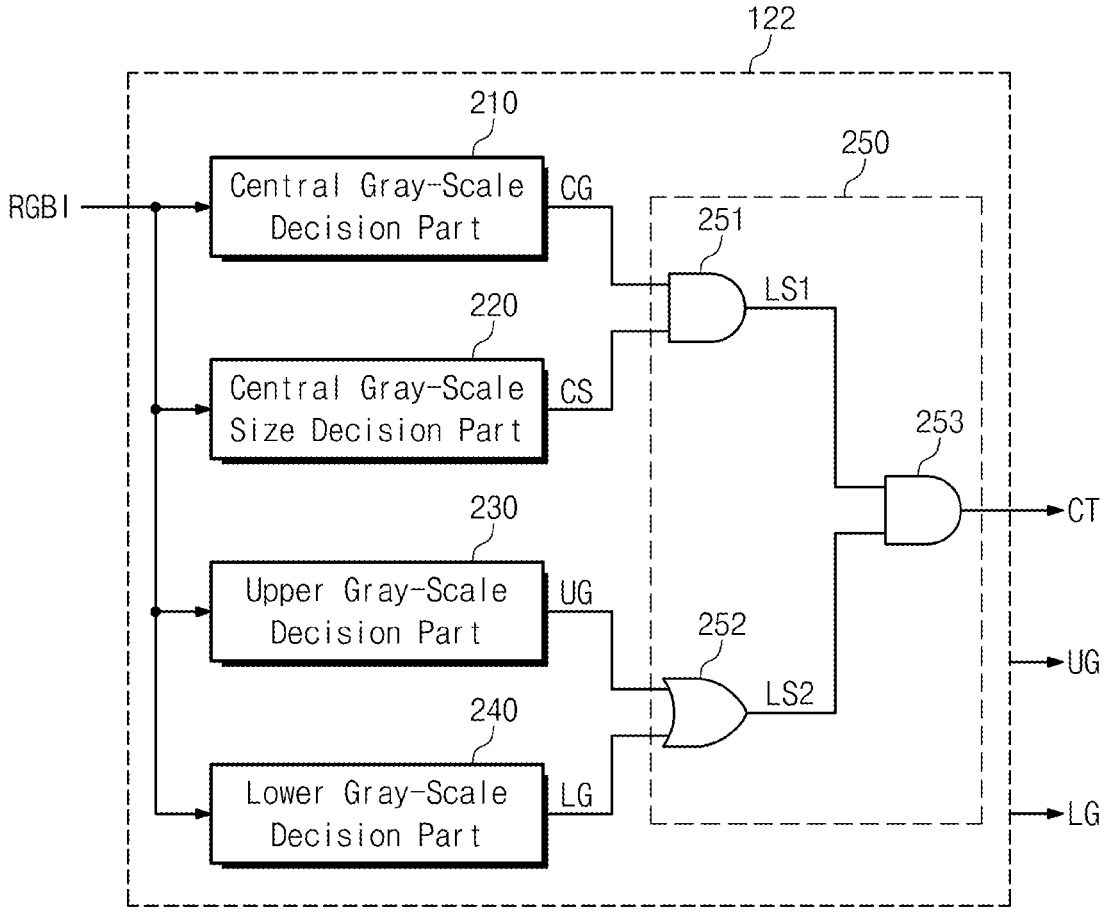
FIG. 9 is a block diagram illustrating a cross-talk decision part of a timing controller according to example embodiments of the invention.

FIG. 9 is a block diagram illustrating the cross-talk decision part 122 of the timing controller 120 illustrated in FIG. 8 according to example embodiments of the invention.

Referring to FIG. 9, the cross-talk decision part 122 may include a central gray-scale decision part 210, a central gray-scale size decision part 220, an upper gray-scale decision part 230, a lower gray-scale decision part 240, and a logic circuit 250.

Referring to FIG. 9 and FIG. 3, the terms "central gray-scale", "upper gray-scale", and "lower gray-scale" may refer to the gray-scales of an image signal RGBI that correspond to a second region A2, an upper region UP, and a lower region DN, respectively. The terms "first gray-scale" and "second gray-scale" may refer to the gray-scales of an image signal RGBI that correspond to an upper region UP and a lower region DN, respectively.

The central gray-scale decision part 210 may determine whether there is the second region A2 (e.g., shown in FIG. 3) in an image to be displayed according to the image signal RGBI and may output a central gray-scale decision signal CG in accordance with the result of the determination. The central gray-scale decision part 210 may output the central gray-scale decision signal CG having a first level (e.g., a high level) if a series of image signals RGBI for gray-scale voltages to be provided to pixels through a specific data line include an upper gray-scale and a central gray-scale, if a difference between the upper gray-scale and the central gray-scale is greater than a first reference value REF1, and if the central gray-scale is greater than a second reference value REF2. If the difference between an upper gray-scale and a central gray-scale is greater than the first reference value REF1, the associated image signal RGBI may be determined to be a cross-talk image pattern.

The central gray-scale size decision part 220 may be configured to count the number of the image signals RGBI having the central gray-scale to evaluate a height (or size) L of the second region A2 in the second direction D2. The central gray-scale size decision part 220 may output a central gray-scale size decision signal CS corresponding to the results of the counting and evaluating. If the number of the image signals RGBI having the central gray-scale and/or the height L is larger than a size reference number REFS, the central gray-scale size decision part 220 may output the central gray-scale size decision signal CS with the first level (e.g., a high level).

The upper gray-scale decision part 230 may output an upper gray-scale decision signal UG with the first level (e.g., a high level) if an upper gray-scale is smaller than a third reference value REF3.

The lower gray-scale decision part 240 may output a lower gray-scale decision signal LG with the first level (e.g., a high level) if a lower gray-scale is smaller than a fourth reference value REF4.

The first reference value REF1, the second reference value REF2, the third reference value REF3, and the fourth reference value REF4 may be set in such a way that a brightness difference may be inconspicuous and/or may not be readily perceivable to a viewer.

The logic circuit 250 may include AND gates 251 and 253 and an OR gate 252. The AND gate 251 may receive a central gray-scale decision signal CG and a central gray-scale size decision signal and may then output a first logic signal LS1. The OR gate 252 may receive an upper gray-scale decision signal UG and a lower gray-scale signal LG and may then output a second logic signal LS2. The AND gate 253 may receive the logic signals LS1 and LS2 and may then output a cross-talk decision signal CT.

If both of the central gray-scale decision signal CG and the central gray-scale size decision signal CS have the first level and if at least one of the upper gray-scale decision signal UG and the lower gray-scale decision signal LG has the first level, the cross-talk decision part 122 may output the cross-talk decision signal CT with the first level.

Figure 10:
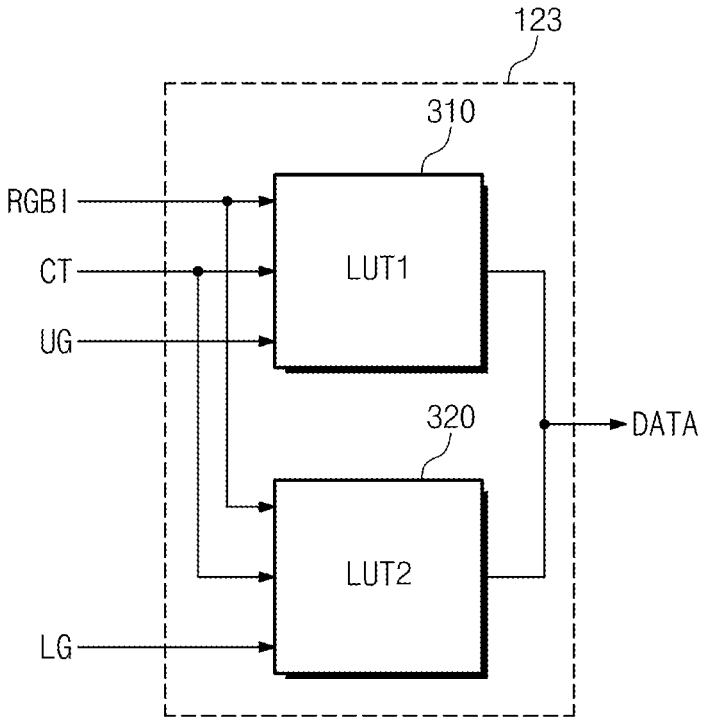
FIG. 10 is a block diagram illustrating a compensation part of a timing controller according to example embodiments of the invention.

FIG. 10 is a block diagram illustrating the compensation part 123 of the timing controller 120 illustrated in FIG. 8 according to example embodiments of the invention.

Referring to FIG. 10, the compensation part 123 may include a first lookup table 310 and a second lookup table 320. The first lookup table 310 may output a data signal DATA by compensating an image signal RGBI in response to a cross-talk decision signal CT and an upper gray-scale decision signal UG. The second lookup table 320 may output a data signal DATA compensating an image signal RGBI in response to a cross-talk decision signal CT and a lower gray-scale decision signal LG.

Figure 11:
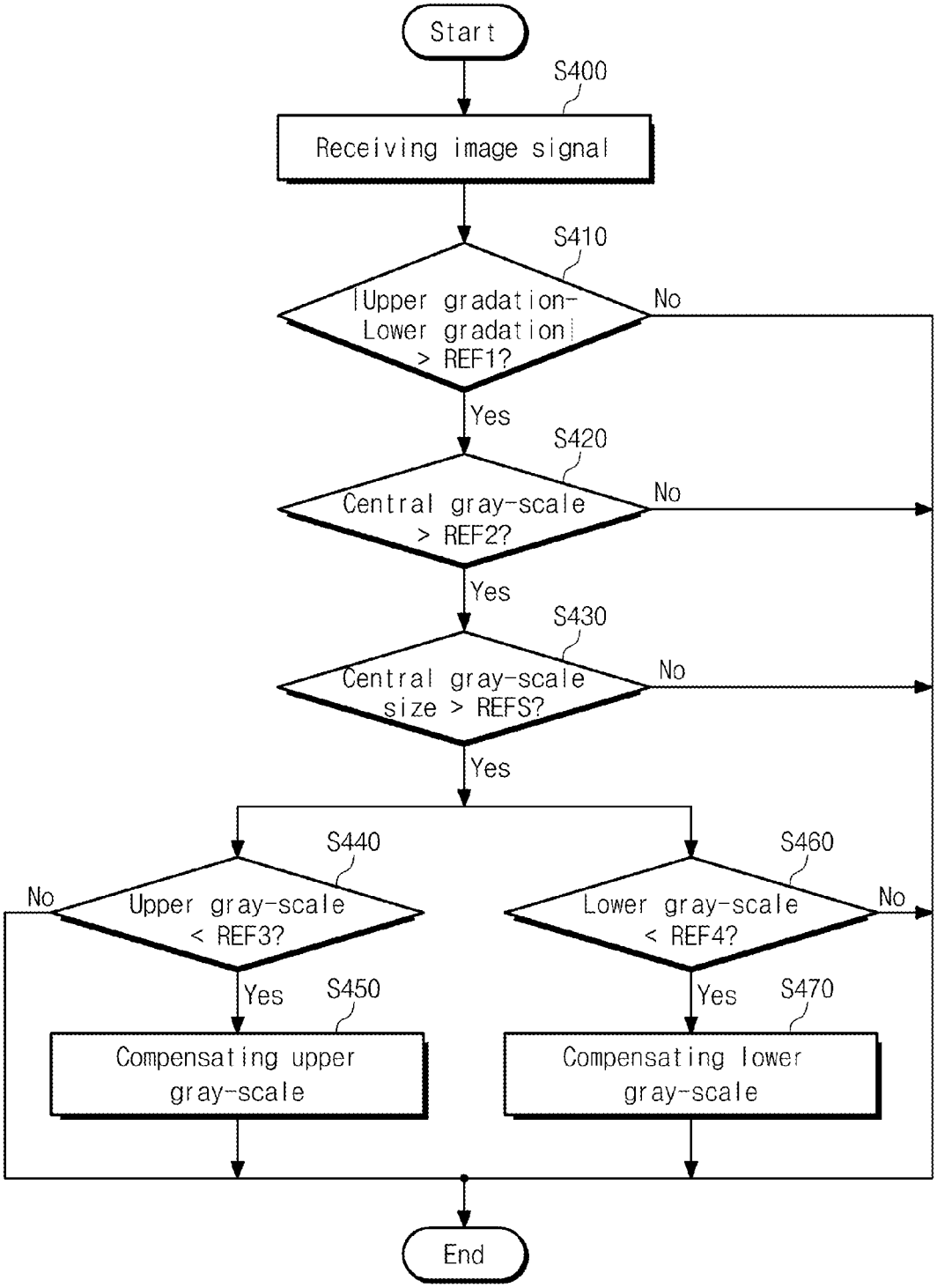
FIG. 11 is a flow chart illustrating an operation of a timing controller of a display device for controlling the display device according to example embodiments of the invention.

FIG. 11 is a flow chart illustrating an operation of the timing controller 120 illustrated in FIG. 8 for controlling the display device 100 illustrated in FIG. 1 according to example embodiments of the invention.

The timing controller 120 may receive input image signals RGB and may store the image signals RGB in the input buffer 121 (in step S400). The timing controller 120 may provide image signals RGBI, which may be a portion of the image signals RGB stored in the input buffer 121 and configured for generation of gray-scale voltages to be transmitted to the blue sub-pixels B21-B225 through the data line DL6, to the cross-talk decision part 122. The image signals RGBI may include image signals having an upper gray-scale, a central gray-scale, and a lower gray-scale for displaying a cyan color, a blue color, and a cyan color, respectively.

If the cross-talk decision part 122 decides that the difference between the upper gray-scale and the central gray-scale is greater than the first reference value REF1 (in step S410) and if the cross-talk decision part 122 decides that the central gray-scale is greater than the second reference value REF2 (in step S420), the central gray-scale decision part 210 may set the central gray-scale decision signal CG to the first level. For example, the central gray-scale decision part 210 may set the central gray-scale decision signal CG to the first level when a difference between the upper gray-scale corresponding to the cyan color (for a gray-scale voltage to be transmitted to the blue sub-pixels B21-B23) and the central gray-scale corresponding to the blue color (for a gray-scale voltage to be transmitted to the blue sub-pixels B24-B223) is greater than the first reference value REF1 and when the central gray-scale corresponding to the blue color (for the blue sub-pixels B24-B223) is greater than the second reference value REF2.

If the number of the image signals RGBI corresponding to the central gray-scale is larger than the reference number REFS (in step S430), the central gray-scale size decision part 220 may set the central gray-scale size decision signal CS to the first level.

If the upper gray-scale is smaller than the third reference value REF3 (in step S440), the upper gray-scale decision part 230 may set the upper gray-scale decision signal UG to the first level. For example, if the upper gray-scale corresponding to the cyan color (for a gray-scale voltage to be transmitted to the blue sub-pixels B21-B23) is smaller than the third reference value REF3, the upper gray-scale decision signal UG may be set to the first level.

If the lower gray-scale is smaller than the fourth reference value REF4 (in step S460), the lower gray-scale decision part 240 may set the lower gray-scale decision signal LG to the first level. For example, if the lower gray-scale corresponding to the cyan color (for a gray-scale voltage to be transmitted to the blue sub-pixels B224-B225) is smaller than the fourth reference value REF4, the lower gray-scale decision signal LG may be set to the first level.

Referring to FIG. 4, in embodiments, since all of the central gray-scale decision signal CG, the central gray-scale size decision signal CS, the upper gray-scale decision signal UG, and the lower gray-scale decision signal LG have the first level, the cross-talk decision signal CT has the first level.

The first lookup table 310 of the compensation part 123 shown in FIG. 10 may output a first portion of the data signal DATA by compensating the upper gray-scale of the image signal RGBI corresponding to the upper region UP (e.g., corresponding to the blue sub-pixels B21-B23) in response to the cross-talk decision signal CT and the upper gray-scale decision signal UG (in step S450). According to the compensated upper gray-scale in the data signal DATA, the data driver 140 may generate a gray-scale voltage to be transmitted to the blue sub-pixels B21-B23.

The second lookup table 320 of the compensation part 123 shown in FIG. 10 may output a second portion of the data signal DATA by compensating the lower gray-scale of the image signals RGBI corresponding to the lower region DN (e.g., corresponding to the blue sub-pixels B224-B225) in response to the cross-talk decision signal CT and the lower gray-scale decision signal LG (in step S470). According to the compensated lower gray-scale in the data signal DATA, the data driver 140 may generate a gray-scale voltage to be transmitted to the blue sub-pixels B224-B225. As a result, cross-talk between different regions of a displayed image potentially caused by variation of gray-scale voltage may be prevented or substantially minimized. Advantageously, the display device 100 may display images with satisfactory quality.

According to example embodiments of the invention, if variation in gray-scale of a series of image signals may potentially cause conspicuous brightness difference in a displayed image, e.g., because of coupling capacitance between a data line and a pixel, the timing controller 120 may compensate the image signals before providing the data signal DATA to the data driver. Accordingly, conspicuous spatial variation of brightness in displayed images may be substantially prevented or minimized. Advantageously, the display device 100 may display images with satisfactory quality.

While example embodiments of the invention have been particularly shown and described, it will be understood by one of ordinary skill in the art that variations (e.g., in form and detail) may be made therein without departing from the spirit and scope of the attached claims.

What is claimed is:

1. A display device comprising:

a data line;

a display panel comprising sub-pixels that are electrically connected to the data line, the sub-pixels including a first sub-pixel positioned in a first region of the display panel and a second sub-pixel positioned in a second region of the display panel;

a timing controller configured to receive a set of first-type image signals and a set of second-type image signals, the first-type image signals corresponding to a first gray-scale and corresponding to the first region of the display panel, the second-type image signals corresponding to a second gray-scale and corresponding to the second region of the display panel, the timing controller being further configured to use the first gray-scale to generate a first compensated gray-scale if a difference between the first gray-scale and the second gray-scale is greater than a first reference value; and a data driver electrically connected to the data line, configured to generate a first gray-scale voltage according to the first compensated gray-scale, and configured to provide the first gray-scale voltage through the data line to the first sub-pixel.

2. The display device of claim 1, wherein the sub-pixels are arranged in a column that is parallel to an extending direction of the data line.

3. The display device of claim 2, wherein the data driver is configured to generate a second gray-scale voltage according to the second gray-scale, and wherein the data driver is configured to provide the second gray-scale voltage through the data line to the second sub-pixel after having provided the first gray-scale voltage through the data line to the first sub-pixel.

4. The display device of claim 1, wherein the timing controller is configured to generate the first compensated gray-scale if the second gray-scale is greater than a second reference value.

5. The display device of claim 1, wherein the timing controller is configured to generate the first compensated gray-scale if the number of the second-type image signals is greater than a threshold number.

6. The display device of claim 1, wherein the timing controller is configured to generate the first compensated gray-scale if the second gray-scale is greater than a second reference value and if the first gray-scale is less than a third reference value, and wherein the third reference value is greater than the second reference value.

7. The display device of claim 1, wherein the sub-pixels further includes a third sub-pixel positioned in a third region of the display panel, wherein the timing controller is configured to further receive a set of third-type image signals that corresponds to a third gray-scale and corresponds to the third region of the display panel, and wherein the second region is positioned between the first region of the display panel and the third region of the display panel.

8. The display device of claim 7, wherein the timing controller is configured to use the third gray-scale to generate a second compensated gray-scale if the second gray-scale is greater than a second reference value and if the third gray-scale is less than a third reference value, and wherein the data driver is configured to generate a second gray-scale voltage according to the second compensated gray-scale and configured to provide the second gray-scale voltage through the data line to the third sub-pixel.

9. A controller connected to a data driver for controlling operation of a display panel, the display panel including sub-pixels that are electrically connected to a data line, the data line being electrically connected to the data driver, the sub-pixels including a first sub-pixel positioned in a first region of the display panel and a second sub-pixel positioned in a second region of the display panel, the controller comprising:

a cross-talk decision part configured to receive a set of first-type image signals and a set of second-type image signals, the first-type image signals corresponding to a first gray-scale and corresponding to the first region of the display panel, the second-type image signals corresponding to a second gray-scale and corresponding to the second region of the display panel, the cross-talk decision part being further configured to provide a cross-talk decision signal that has an activation value if a difference between the first gray-scale and the second gray-scale is greater than a first reference value; and a compensation part configured to use the first gray-scale to generate a first compensated gray-scale in response to the cross-talk detection signal that has the activation value and configured to provide the first compensated gray-scale to the data driver for enabling the data driver to generate a first gray-scale voltage according to the first compensated gray scale and to provide the first gray-scale voltage through the data line to the first sub-pixel; and hardware configured to perform one or more tasks associated with at least one of the cross-talk decision part and the compensation part.

10. The controller of claim 9, wherein the sub-pixels further includes a third sub-pixel positioned in a third region of the display panel, wherein the cross-talk decision part is configured to further receive a set of third-type image signals that corresponds to a third gray-scale and corresponds to the third region of the display panel, and wherein the compensation part is further configured to use the third gray-scale to generate a second compensated gray-scale in response to the cross-talk detection signal that has the activation value and configured to provide the second compensated gray-scale to the data driver for enabling the data driver to provide a second gray-scale voltage through the data line to the third sub-pixel.

11. The controller of claim 10, wherein the cross-talk decision part comprises:

a central gray-scale decision part configured to compare a difference between the first gray-scale and the second gray-scale with the first reference value for outputting a central gray-scale decision signal;

a central gray-scale size decision part configured to compare the number of the second-type image signals with a threshold number for outputting a central gray-scale size decision signal;

an upper gray-scale decision part configured to compare the first gray-scale with a second reference value for outputting an upper gray-scale decision signal;

a lower gray-scale decision part configured to compare the third gray-scale with a third reference value for outputting a lower gray-scale decision signal; and a logic circuit configured to generate a cross-talk detection signal in response to the central gray-scale decision signal, the central gray-scale size decision signal, the upper gray-scale decision signal, and the lower gray-scale decision signal.

12. The controller of claim 11, wherein the logic circuit comprises:

a first logic unit configured to output a first logic signal in response to the central gray-scale decision signal and the central gray-scale size decision signal;

a second logic unit configured to output a second logic signal in response to the upper gray-scale decision signal and the lower gray-scale decision signal; and a third logic unit configured to output the cross-talk detection signal in response to the first logical signal and the second logic signal.

13. The controller of claim 12, wherein the compensation part comprises:

a first lookup table configured to output the first compensated gray-scale in response to at least one first-type image signal of the first-type image signals, the cross-talk detection signal, and the upper gray-scale decision signal; and a second lookup table configured to output the second compensated gray-scale in response to at least one third-type image signal of the third-type image signals, the cross-talk detection signal, and the lower gray-scale decision signal.

14. The controller of claim 11, wherein the first logic unit is a first AND gate, wherein the second logic unit is an OR gate, and wherein the third logic unit is a second AND gate.

15. The controller of claim 11, wherein the central gray-scale decision signal has the activation value if the difference is greater than the first reference value, wherein the central gray-scale size decision signal has the activation value if the number of the second-type image signals is greater than the threshold number, wherein the upper gray-scale decision signal has the activation value if the first gray-scale is less than the second reference value, wherein the lower gray-scale decision signal has the activation value if the third gray-scale is less than the third reference value, and wherein the compensation part is configured to generate the first compensated gray-scale and the second compensated gray-scale if both of the central gray-scale decision signal and the central gray-scale size decision signal have the activation value and if at least one of the upper gray-scale decision signal and the lower gray-scale decision signal has the activation value.

16. The controller of claim 15, wherein the compensation part is configured not to generate the first compensated gray-scale and not to generate the second compensated gray-scale if neither of the upper gray-scale decision signal and the lower gray-scale decision signal has the activation value.

17. A method for controlling a display device, the display device including a data driver, a data line electrically connected to the data driver, and a display panel including sub-pixels that are electrically connected to the data line, the sub-pixels including a first sub-pixel positioned in a first region of the display panel and a second sub-pixel positioned in a second region of the display panel, the method comprising:

receiving a set of first-type image signals and a set of second-type image signals, the first-type image signals corresponding to a first gray-scale and corresponding to the first region of the display panel, the second-type image signals corresponding to a second gray-scale and corresponding to the second region of the display panel;

using the first gray-scale to generate a first compensated gray-scale if a difference between the first gray-scale and the second gray-scale is greater than a first reference value; and providing the first compensated gray-scale to the data driver for enabling the data driver to generate a first gray-scale voltage according to the first compensated gray scale and to provide the first gray-scale voltage through the data line to the first sub-pixel.

18. The method of claim 17, further comprising:

comparing the second gray-scale with a second reference value;

comparing the number of the second-type image signals with a threshold number;

comparing the first gray-scale with a third reference value; and generating the first compensated gray-scale if the number of the second-type image signals is greater than the threshold number and if the first gray-scale is less than the third reference value.

19. The method of claim 17, further comprising:

receiving a set of third-type image signals that corresponds to a third gray-scale and corresponds to a third region of the display panel, wherein the sub-pixels further includes a third sub-pixel that is positioned in the third region of the display panel;

comparing the third gray-scale with a fourth reference value;

using the third gray-scale to generate a second compensated gray-scale if the difference between the first gray-scale and the second gray-scale is greater than the first reference value and if the third gray-scale is less than a second reference value; and providing the second compensated gray-scale to the data driver for enabling the data driver to generate a second gray-scale voltage according to the second compensated gray scale and to provide the second gray-scale voltage through the data line to the third sub-pixel.

20. The method of claim 17, further comprising:

comparing the number of the second-type image signals with a threshold number;

comparing the first gray-scale with a second reference value;

providing the first gray-scale to the data driver for enabling the data driver to generate a first data voltage according to the first gray scale and to provide the first data voltage to the first sub-pixel if the difference is less than the first reference value, if the number of the second-type image signals is less than the threshold number, or if the first gray-scale is greater than the second reference value.

* * * * *